United States Patent [19]

Perbal, deceased et al.

[11] 3,994,464

[45] Nov. 30, 1976

[54] INTERNALLY WIRED COUNTER-BALANCED BRACKET

[76] Inventors: Albert C. Perbal, deceased, late of St. Louis, Mo.; by Martha Louise Perbal, 4400 Lindell Blvd., St. Louis, Mo. 63108; Mercantile Trust Company National Association, co-executors, 721 Locust St., St. Louis, Mo. 63101

[22] Filed: Jan. 9, 1976

[21] Appl. No.: 647,877

[52] U.S. Cl. ..... 248/280; 240/81 BD; 248/281

[51] Int. Cl.[2] ..... A47H 1/10

[58] Field of Search ..... 248/280, 281, 123, 292, 248/297; 240/73 BU, 81 BD, 81 BE

[56] References Cited

UNITED STATES PATENTS

| | | | |
|---|---|---|---|
| 3,391,890 | 7/1968 | Perbal | 248/280 |
| 3,396,931 | 8/1968 | Eckstein | 248/280 |
| 3,476,931 | 11/1969 | Fletcher | 240/81 |
| 3,489,384 | 1/1970 | Perbal | 248/280 |
| 3,790,773 | 2/1974 | Sapper | 248/280 |
| R17,845 | 10/1930 | Bosworth | 248/292 |

*Primary Examiner*—Robert A. Hafer

[57] ABSTRACT

In that type of extensible, tiltable counter-balanced lamp bracket in which three degrees of freedom are provided about a balance point, the mechanism which furnishes the 3° of freedom also provides a hollow encompassing the balance point, so that connectors may be drawn directly therethrough. A hollow link extends from the balance point to a fulcrum hinge at which it mounts the principal counter-balanced arm. The arm there is directed into two portions offset from the center plane. The offsets of the principal arm provide a slot in which the link means is accommodated when the extensible bracket is folded.

8 Claims, 5 Drawing Figures

INTERNALLY WIRED COUNTER-BALANCED BRACKET

BACKGROUND OF THE INVENTION

A popular type of lamp, used on desks, work tables, drawing boards, for medical examinations and the like, utilizes a bracket having a principal arm mounted on a fulcrum, and an extensible forward arm hinged to the principal arm. One form of extensible lamp bracket is both counter-balanced and tiltable out of a central vertical plane; this form is disclosed in U.S. Pat. No. 3,391,890. The mechanism there shown contains provisions which permit three degrees of angular movement about the balance point, as with a ball joint. These provisions occupied the balance point itself so that electrical connectors could not be internal, and the fulcrum hinge presented a similar wiring problem.

In this type of lamp bracket, balancing at various degrees of extension was achieved by maintaining maintained proportionality between the extension of the forward arm forwardly of the balance point, and aft movement of the counter-balance. Proportionality was achieved by a rod which in effect maintains the forward arm parallel to a link from the balance point to the fulcrum hinge of the principal arm. In the patented construction, the fulcrum hinge was spaced below the principal arm; the parallelism-maintaining rod was spaced still further below. This separation interfered with compact folding of the bracket.

SUMMARY OF THE INVENTION

The principal purpose of the present invention is to create joint and link members, in a counter-balanced extensible bracket of the type described, which permit the drawing of concealed electrical connectors through the point about which there are three degrees of freedom of angular movement, and also through the fulcrum hinge. Another purpose is to provide improved compactness of folding of such an extensible bracket, so that its parallelism maintaining rod and forward arm may fold back against the principal arm with the three being closely adjacent to each other. Still other purposes will be apparent from the detailed disclosure which follows.

Generally summarizing the present invention, I provide three degrees of angular movement at the balance point, without interfering with electrical connectors drawn therethrough. The mechanism which provides each degree of freedom is located offset from the balance point itself, which the mechanism encompasses. Wiring is carried up through a lower support which rises from the swivel mechanism. In the embodiment illustrated the wiring extends from this swiveling support through a hollow trunnion whose supporting joints are laterally offset from the balance point. At the trunnion midpoint is the end of a hollow stub shaft formed about a center plane axis perpendicular to the lateral trunnion axis. Loosely clamped about this stub shaft, so that it may turn thereon, is the swivel socket portion of a hollow link which extends from the balance point to the fulcrum hinge, on which the principal bracket arm is mounted. In this hollow mechanism the wiring is concealed.

The fulcrum hinge axis is located along the center line of the principal arm instead of below it as in the patented construction above referred to. The principal arm is there divided into two portions offset from the central vertical plane of the bracket. The slot between these offset arm portions accommodates the upper end of the link. When the supplemental arm is folded back on the principal arm, nearly the entire link passes into the slot; there remains projecting only a link end portion which extends to the balance point and a lug on which the parallelism-maintaining rod is mounted. This permits exceptional compactness of folding.

It is to be understood that this preliminary summary is furnished to aid in understanding the disclosure which follows and does not limit the scope of the invention.

Figure 3:
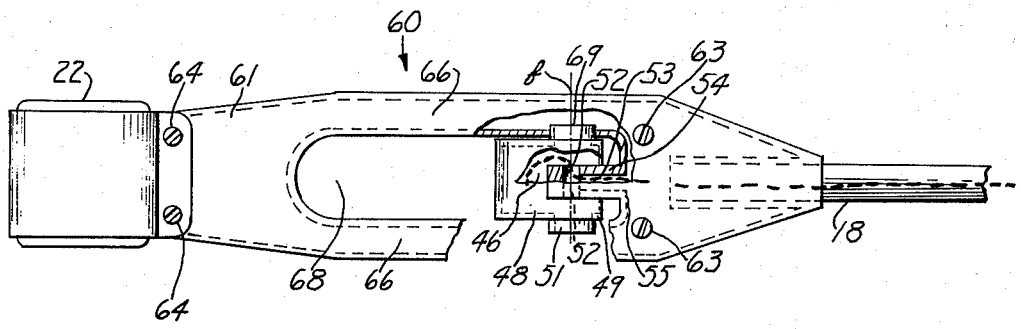
FIG. 3 is an enlarged true view, broken away, showing the fulcrum hinge and counter-balance portion of FIG. 1, as seen from the upper left.
Figure 4:
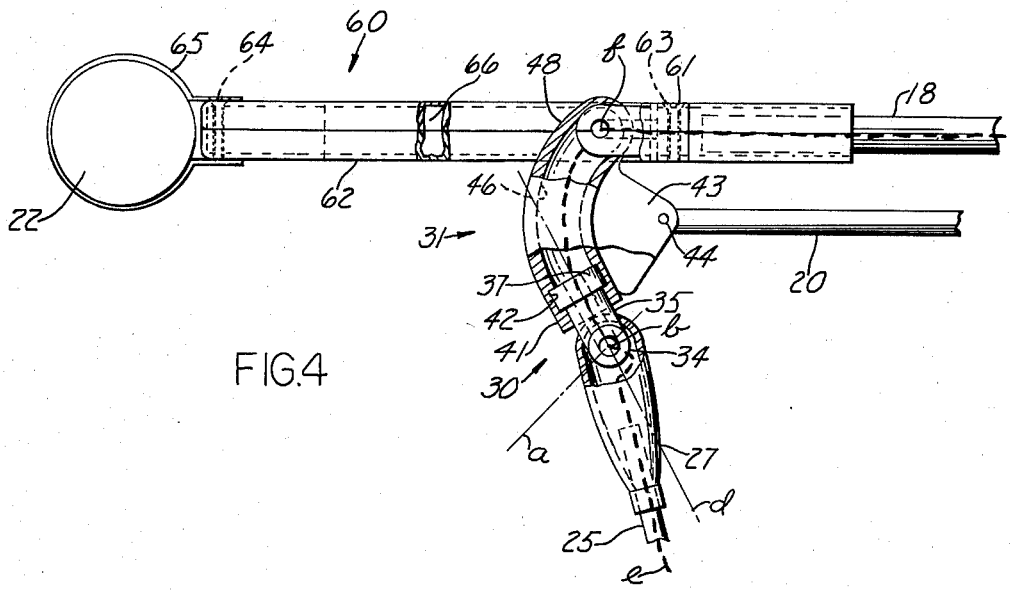
FIG. 4 is a side view, partly broken away, of the parts shown in FIG. 3, in their same relative positions.
Figure 5:
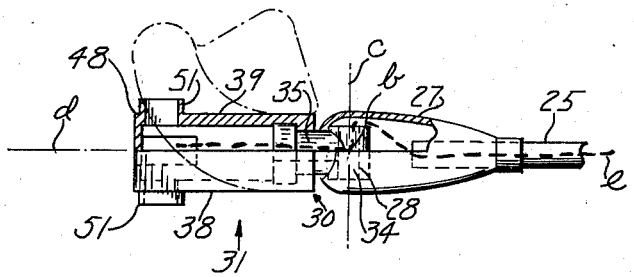
FIG. 5 is a true view of the joint members seen from the left and below of FIG. 4. The phantom lines show the link member thereof swiveled 90°, as when the bracket is tilted out of the central vertical plane.

The heavy dash lines in the enlarged fragmentary views FIGS. 3, 4, and 5 indicate the path of wiring.

DESCRIPTION OF THE PREFERRED EMBODIMENT

Figure 1:
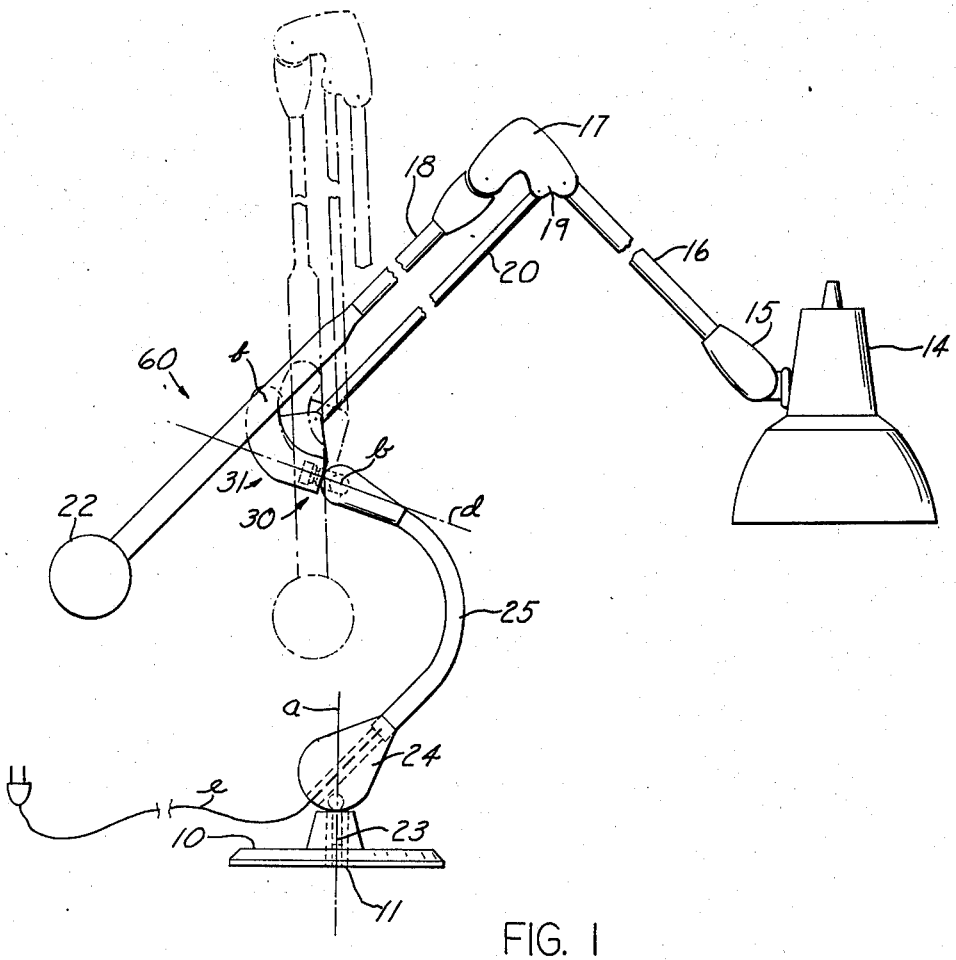
FIG. 1 is an elevational view, partly broken away, of a counter-balanced extensible lamp bracket embodying the present invention, shown with the tiltable bracket partially extended in the vertical plane. The phantom lines show the bracket portions fully folded vertically.

The terms applied to the relative position of the parts, throughout this description and the appended claims, define their positions when the base 10 is on a horizontal level surface and the other parts are in their relative positions shown in FIG. 1.

Certain parts of the present invention are similar to parts having corresponding functions disclosed in said prior U.S. Pat. No. 3,391,890; these corresponding parts will be first described. A relatively small lightweight circular base 10 is utilized having a central vertical base swivel bushing 11 which defines a vertical support axes *a*. The base 10 may be equipped with a pair of common support recesses 12 which are narrowed at one side so as to grasp projecting heads of nails or screws, thus to permit wall mounting of the base 10.

Other parts of the present bracket, which will be familiar from said prior patent, are: the swivel mounted lamp head 14, its mounting joint 15, which moves angularly relative to a supplementary hollow arm 16, the hinge joint 17 of the supplementary arm 16 to the principal arm 18, which joint also includes a lug fitting 19 for mounting the upper end of a parallelism-maintaining rod 20, and the mass counter-balance 22 supported at the aft end of a slotted fulcrum hinge fitting, to be described, mounted on that end of the principal arm 18 opposite to the hinge joint 17.

A support point *b*, about which the present bracket provides limited movement about three axes, is seen in FIGS. 1, 4, and 5. It lies at the intersection of the axis *a* provided by the base swivel bushing 11, a lateral axis *c* perpendicular thereto, as seen in FIG. 5, and a central plane axis *d* perpendicular to the lateral axis *c* and rotatable relative thereto through a substantial angle as partly seen in FIG. 1. The support point *b* is thus spaced vertically from the base swivel bushing 11, and as will be seen is likewise spaced from the members which provide for support and rotation relative to the other axes *c*, *d*.

Arising from the base 10 and supported in the swivel bushing 11 by a pin 23 are the somewhat pear-shaped lower fitting ends 24 of a hollow tubular support 25 which rises curving forward from the axis *a* and then returns toward it as seen in FIG. 1. At its upper end, best seen in FIGS. 4 and 5, is a non-rotatable hollow fitting 27 split along the central vertical plane of the bracket, and having on each side thereof an inward facing hollow trunnion lug 28. The fitting 27 may be held together by a simple clamping screw (not shown) whose tightening exerts a variable clamping force on the trunnion lugs 28. The trunnion lugs 28 define the lateral axis *c* through the support point *b;* and as seen in FIG. 5, they are spaced to both sides of it, so that electrical connectors, generally designated *e*, drawn through the fitting ends 24 into the tubular support 25 and then to the hollow fitting 27, may pass through one of its hollow trunnion lugs 28 and through the support point *b* itself.

Mounted between the trunnion lugs 28 is a first link part generally designated 30, which supports a swiveling second link part generally designated 31. Together they extend from the support point *b* to the fulcrum hinge point *f* as seen in FIGS. 1 and 4. The first link part 30 includes a hollow tubular trunnion 34, best seen in FIG. 5, which extends between and whose ends are embraced by the trunnion lugs 28 of the fitting 27. A short hollow stub shaft 36 extends perpendicular to the trunnion 34. The axis of the stub shaft 35 is the center plane axis *d*.

Figure 2:
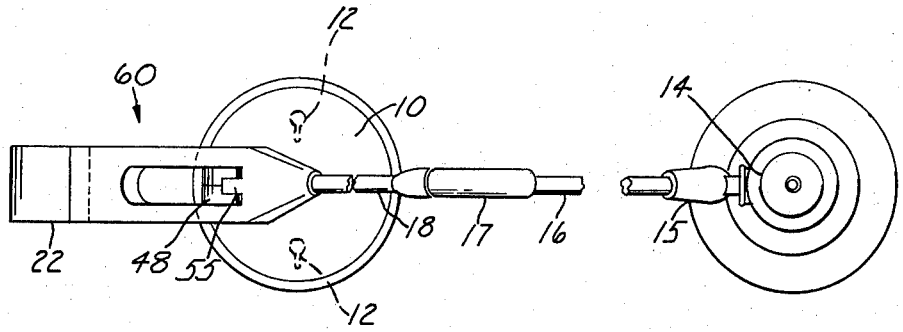
FIG. 2 is a plan view corresponding to FIG. 1.

The stub shaft 35 of the first link part 30 is provided with an enlarged preferably cylindrical flange 37 which is grasped by the second link part 31, hereafter to be described, for permitting relative rotation about the center plane axis *d*. Movement about this axis will tilt all portions supported by the second link member 31—including the lamp head 14, the principal and supplementary arms 18, 16, the parallelism-maintaining rod 20 and the counter-balance 22—out of the center plane illustrated in FIGS. 1 and 2.

The second link part 31 consists of symmetrical left and right hand pieces 38, 39 which, when the link part 31 is in position shown in FIG. 1, mate at the central vertical plane of the lamp bracket. The pieces 38 and 39 are hollowed to provide a path for the wiring as seen by the heavy dash lines of FIGS. 3, 4, and 5. Together the parts 38, 39 present a cylindrical hollowed neck 41 entering into a cylindrical swivel socket 42 in which the stub shaft 35 and its cylindrical flange 37 of the first link part 30 are received. Hence the second link part 31 swivels on the axis *d*, as shown in FIG. 5. Although its entrant neck and swivel socket 42 are on a common axis, the part 31 curves substantially in an arc; within the arc are flat tab portions 43 which meet at the center plane and are bored to accommodate a lateral pin 44 which mounts one end of the parallelism-maintaining rod 20. A screw (not shown) through the tab portions 43 holds the link pieces 38, 39 together so their socket 42 exerts adjustable clamping pressure on the flange 37 of the first link part 30.

A hollow passage 46 extends through the second link part 31 from the swivel socket 42 curvedly to its fulcrum hinge end 48, best seen in FIGS. 3 and 5. In the embodiment shown, the fulcrum hinge end 48 has symmetrical hollow clevis portions 49 offset to both sides of the center plane. On their outer sides (that is, those farther from the center plane) the clevis portions 49 have annular fulcrum support projections 51 whose hollows are aligned with each other to define the axis of the fulcrum hinge *f*. On this same axis, the inner sides of the clevis portions 49 have bores 52 which lead inwardly. These bores connect with a lateral bore 53 through the aft end of the stem portion 54 of a substantially T-shaped center plane support 55. The stem portion 54 is likewise hollow, so that as seen in FIG. 3 a wire through the hollow passage 46 may pass through one of the clevis portions 49 and its bore 52, and then to the center plane through the clevis lateral bore 53, and then forward through the stem portion 54. Optional annular interfit provisions may be molded to provide support between the clevis portions 49 and the center plane member 55; however in the embodiment shown the outward projecting fulcrum supports 51 are adequate for support at the fulcrum hinge *f*.

One unique feature of the present invention is that the fulcrum hinge *f* extends through the axis of the principal arm 18, on which axis the counter-balance 22 is also located. This location of the fulcrum hinge *f* is accomplished by offsetting the fulcrumed portion of a principal arm fitting 60 from the vertical center plane, providing a slot 68 in it, so the second link part 31 may move freely in this plane. This accommodation is of particular importance when the lamp bracket is fully folded, as seen in the phantom lines in FIG. 1.

FIG. 3 best illustrates the slotted fulcrum fitting generally designated 60, preferably made up of upper and lower molded plastic halves 61, 62 held together by forward screws 63, which clamp between them the end of the tubular principal arm 18, and aft screws 64 which mount the strap 65 around the counterweight 22. Also clamped in place by the screws 63 is the T-shaped center plane member 55. Parallel longitudinal portions 66 of the fitting halves 61, 62 are offset from the center plane sufficiently to accommodate the second link part 31, providing between them a slot 68, whose length is sufficient to accommodate the link part 31 in the fully folded position shown in phantom lines in FIG. 1. At their mating mid-plane, at which the lateral fulcrum axis *f* is located, the upper and lower halves 61, 62 have molded semi-cylindrical bushing portions 69 which receive the projecting fulcrum supports 51 of the clevis ends 49 of the link parts 31.

The hollow fulcrum supports 51 enter into the hollows of the longitudinal fitting portions 66, as seen in FIG. 3, and are of adequate size to conduct wiring. Thus in a simple embodiment, the T-shaped center plane member 55 may be omitted, and the wiring to an incandescent lamp carried outward through one of the fulcrum support projections 51 and the mating bushing parts 69 into the fitting halves 61, 62 and thence forward through the principal arm 18.

Instead of utilizing a simple incandescent bulb, it may be desirable to use a transformer to change the voltage, as is common with high intensity lamps; or if a fluorescent lamp is to be utilized, ballasts or chokes may be required. With such a design, the transformer, ballast or choke may be incorporated as part of the counterbalance 22. In such case the hollows in the fulcrum fitting 60 may conduct wiring aft to such a component and thence forwardly to the principal arm 18.

As taught in said prior Pat. No. 3,391,890, the range of angular movement of the central plane axis *d* about the lateral axis *c* should be restricted so that this central plane axis *d* does not come into coincidence with the vertical support axis *a*. It is inherent in this balanced bracket construction that a line connecting the support point *b* with the fulcrum *f* must be substantially parallel to the line from the hinge joint 17 to the center of gravity of the masses forward of the support point *b*, that is, substantially parallel to the supplementary arm 16. Since in its desired range of movement this arm 16 may be vertical, the second link part 31 cannot be straight but must be curved aft and up, as shown in FIG. 1. This requirement of curvature is utilized to achieve better folding. The slot 68 conveniently accommodates nearly the entire curved second fitting member 31, leaving exposed only the knuckle-like joint at the support point *b*. The result is exceptional compactness of folding, illustrated in phantom lines of FIG. 1, in which the principal arm 18, parallelism-maintaining rod 20 and supplementary arm 16 are brought close together and parallel to each other.

Inasmuch as the concept of three degrees of freedom of angular movement about a point is associated with ball joints, it was not originally anticipated that wiring could be brought through the support point itself, to accommodate any such angular movement merely by flexure. Similarly, it was not apparent how to carry wiring, in a counter-balanced bracket, subject only to flexure, through this fulcrum joint of a levered arm which entered both forward and aft of the joint. Nor was it apparent to create an offset levered arm with a slot in which to accommodate a curved link of a parallel-maintaining mechanism.

A unique advantage of the type of counter-balanced bracket described in this specification is: since balance is achieved about the balance point with three degrees of freedom of angular position and throughout the range of extension of the bracket, the support axis from the base to the balance point, which axis is hereinabove described as "vertical" may be inclined at any angle or even positioned horizontally. Thus a drafting board on which the bracket may be mounted can be readily inclined without affecting the function of the bracket; or the base plate may be mounted on a vertical wall, to position this "vertical" axis horizontally. The very flexibility of the present bracket in use at varying positions and angles of inclination, makes it difficult to select words to describe the individual parts and their functions. In drafting this specification, the words used were selected to describe the members as they appear in the elevational view, FIG. 1, with the support axis to the balance point vertical and the central plane of the folding bracket vertical. The breadth of this disclosure is not to be impaired by the selection of this view as a basis relative to which the descriptive terms were chosen. Likewise the wording of the claims, insofar as position and spatial relationships are described, applicable directly to said elevational view FIG. 1, is to be understood to apply to the members and parts of the apparatus at every position and at every angle which they may assume; and this breadth of interpretation is to be applied also to corresponding members of equivalent apparatus.

We claim:

1. In a counter-balanced extensible bracket of the type having a balance point relative to which three degrees of freedom of angular movement are provided, link means supported at said balance point having a link line extending to a fulcrum hinge, a principal hollow arm mounted to said hinge, the arm having an aft extending counter-weighted portion and a forward extending portion terminating in an elbow joint to which a supplementary hollow arm is hinged, with a supported electrical element mounted to said supplementary arm, further having means to maintain substantial parallelism between said supplementary arm and said link line, said means connecting the supplementary arm and the link means at points thereof spacedly offset from the elbow joint and the fulcrum hinge respectively, the improvement adapted to permit drawing of electrical connectors internally, comprising base means spaced from such balance point to establish a support axis intersecting such point, said base means having on said axis a base swivel, and a hollow support member mounted for swiveling therein and whose upper end has hollow means offset laterally from such balance point to provide trunnion-like support about a lateral axis through such support point, and in which said link means includes a first link portion comprising a hollow trunnion part mounted laterally in said means to provide trunnion-like support and communicating with and terminating in a hollow stub shaft end formed about a center-plane axis perpendicular to and which intersects said lateral axis at such balance point, and a second link portion having an end at said fulcrum hinge and having a swivel socket end mounted about said stub shaft end at a position spaced axially from such support point, said second link portion further having a hollow extending from its said socket end to an outlet at said fulcrum hinge, said connection of said parallelism-maintaining means to the link means being made to said second link portion.

2. In a counter-balanced extensible bracket, the improvement as defined in claim 1, wherein said center plane axis of said first link portion, about which said second link portion swivels, diverges angularly from said link line, whereby the said center plane axis will remain out of coincidence with the vertical axis when said link line is raised to vertical, thereby confining vertical swiveling to movement about the base swivel.

3. In a counter-balanced extensible bracket, the improvement as defined in claim 2, wherein the principal hollow arm has a offset sideward from said center plane and extending an said fulcrum hinge toward the counter-weighted portion, whereby to accommodate said second link portion when the supplementary arm is folded closely adjacent to the principal arm.

4. In a counter-balanced extensible bracket, the improvement as defined in claim 3, wherein said principal arm offset includes portions on both sides of said center plane, whereby to provide a slot in which the said second link portion is so accommodated, and wherein said fulcrum hinge includes rotation-permitting means acting between both said offset arm portions and the end of the second link portion thereat.

5. In a counter-balanced extensible bracket, the improvement as defined in claim 3, wherein said second link portion is formed of two members mating at said center plane and which at the fulcrum hinge have clevis ends offset therefrom, the said fulcrum hinge outlet of the link hollow being at one clevis end and extending laterally inward toward the center plane, and in which the hollow principal arm has, extending aft to the fulcrum hinge axis and between said clevis ends, a hollow center plane member, whereby to permit drawing electrical connectors through the link and its said hollow clevis into said center plane member and thence into the hollow arm.

6. In a counter-balanced extensible bracket of the type having a balance point relative to which three degrees of freedom of angular movement are provided, link means supported at said balance point having a link line extending to a fulcrum hinge, a principal hollow arm mounted to said hinge, the arm having an aft extending counter-weighted portion and a forward extending portion terminating in an elbow joint to which a supplementary hollow arm is hinged, with a supported electrical element mounted to said supplementary arm, further having means to maintain substantial parallelism between said supplementary arm and said link line, said means connecting the supplementary arm and the link means at points thereof spacedly offset from the elbow joint and the fulcrum hinge respectively.

the improvement adapted to permit drawing of electrical connectors internally, comprising base means spaced from such balance point to establish a vertical axis intersecting such point, said base means having on said axis a base swivel, and a hollow support member mounted for swiveling therein and whose upper end has hollow means offset from such balance point to provide pivotal support about a horizontal axis through such support point, the said link means being hollow from said offset means to said fulcrum hinge, that end of said link means nearest the balance point being provided with means, offset from the support point and having a hollow encompassing the support point, to provide a range of angular movement of the link means about a third axis perpendicular to such horizontal axis and out of coincidence with said vertical axis, whereby connectors may be carried through said hollow support member and through the balance point and link means to said fulcrum hinge and thence to said hollow arms.

7. In a counter-balanced extensible bracket of the type having a balance point relative to which more than one degree of freedom of angular movement is provided, link means supported at said balance point having a link line extending therefrom to a fulcrum hinge, and a principal hollow arm mounted to said hinge, the arm having an aft extending counter-weighted portion, the improvement adapted to permit accommodation of electrical connectors within said fulcrum hinge, so that hinge movement is accommodated by flexure of the connectors and without displacement thereof, characterized in that the principal arm has offsets sideward from its center plane and extending aft to a counter-weighted portion, said offsets being on both sides of said center plane, whereby to provide a slot in which the link means may be accommodated, the offsets having fulcrum support means aligned with each other on a lateral fulcrum axis, and in which said link means includes two members mating at said center plane, and providing a hollow in which connectors may be drawn, said members having fulcrum means on their outer sides mating with those fulcrum means of the offset arm portions, at least one of said members having a hollow along said fulcrum axis through which connectors with the link means may extend to enter into the principal arm.

8. The improvement as defined in claim 7, further characterized in that at that end of the link means at which said fulcrum means acts, the said two members of the link means have clevis ends offset from the center plane, and in that the said hollow along the fulcrum axis extends inward toward the center plane, and in that the fulcrum hinge includes a hollow center plane member mounted to the principal arm forwardly of the fulcrum axis and extending aft between said clevis ends, whereby although fulcrum hinge support of the principal arm is provided to said offset arm portions outwardly of said clevis ends, the hollow through which electrical connectors may be drawn extends from said one clevis end inwardly to and through said hollow center plane member and thence into the principal arm.

* * * * *